US006789519B1

(12) United States Patent
Bell

(10) Patent No.: US 6,789,519 B1
(45) Date of Patent: Sep. 14, 2004

(54) REMOTE ENGINE STOP/START SYSTEM WITH BACKUP MOTOR CONTROL

(75) Inventor: Joseph A. Bell, Markle, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/690,752

(22) Filed: Oct. 22, 2003

Related U.S. Application Data

(60) Provisional application No. 60/477,908, filed on Jun. 12, 2003.

(51) Int. Cl.[7] ..... F02N 11/08
(52) U.S. Cl. ..... 123/179.2
(58) Field of Search ..... 123/179.2, 179.3, 123/179.4; 180/271, 53.4, 53.5, 53.8, 323

(56) References Cited

U.S. PATENT DOCUMENTS

RE30,686 E * 7/1981 Bucher ..... 123/179.2
4,762,199 A * 8/1988 Holmes ..... 182/2.9
5,990,800 A * 11/1999 Tamaki et al. ..... 123/179.2

* cited by examiner

*Primary Examiner*—Mahmoud Gimie
(74) *Attorney, Agent, or Firm*—Jeffrey P. Calfa; Dennis Kelly Sullivan; Susan L. Lukasik

(57) ABSTRACT

Hydraulically actuated aerial lift units for trucks typically have a primary hydraulic pump system driven by the vehicle's engine or by an electric motor. An actuation system accessible to a worker suspended by the aerial lift unit allows the worker to cycle the vehicle's engine on and off and, on vehicles so equipped, activate the backup motor for lowering the aerial lift unit.

15 Claims, 13 Drawing Sheets

REMOTE ENGINE STOP/START SYSTEM WITH BACKUP MOTOR CONTROL

REFERENCE TO RELATED APPLICATION

This application claims priority from provisional application Ser. No. 60/477,908 filed Jun. 12, 2003.

BACKGROUND OF THE INVENTION

1. Technical Field

The invention relates to power take off systems for utility vehicles and more particularly to a system providing remote starting and stopping of the vehicle and for control of an emergency back up motor to the power take off system.

2. Description of the Problem

Utility vehicles are often advantageously supplied with auxiliary equipment the operation of which is supported by the vehicle. Such auxiliary equipment can include hydraulically powered, aerial lift buckets that are often used for the repair of electrical power distribution lines. Typically, a hydraulic lift platform will be driven by a pump which is in turn driven by the vehicle's engine. In some applications, a back up prime mover, e.g. an electrical motor, is provided for the pump. A bucket at the end of the aerial lift system is electrically isolated to allow the worker to work on power lines which are still hot.

Trucks may come equipped with controls to allow a worker supported in the bucket to remotely shut off and turn on the vehicle's engine and to remotely raise and lower the lift. To avoid providing a conductive electrical path between the bucket and the truck, the controls located in and around the bucket for the operator's use are usually pneumatic. An air line is connected between the bucket, where a plunger-actuated piston is positioned, and a pneumatic, pressure actuated, electrical switch on the truck. To avoid expense a minimal number of pneumatic lines is provided. A problem addressed by the invention is providing a single, pneumatic, pressure actuated electrical switch which can be used to both start and stop a truck's engine, and in some applications, allow activation of a back up hydraulic pump in case of engine failure. Complicating the effort to construct such a device is the susceptibility of vehicle electronics to resetting during engine starting due to voltage fluctuations.

Industry standards specify that the bucket control for an aerial lift truck having an emergency or back up pump shall: (1) if the engine is running and the remote switch is closed (regardless of the duration for which it is held closed), shut down the engine; (2) if the remote switch is kept depressed for more than 3 seconds following a remote engine stop, cause the emergency or back up pump to operate and to continue to operate for as long as the switch is held closed; (3) if the remote switch is cycled following a remote stop or following the operation of the emergency pump, cause the engine to crank for the duration of the switch closure; and (4) if the engine does not start after cranking, respond to cycling the remote switch by causing the emergency pump to operate for as long as the remote switch is depressed.

Contemporary vehicles are commonly equipped with an electrical systems controller/body computer (ESC) and a controller area network allowing data transfer between the ESC and other controllers, including an engine controller and a transmission controller. These systems are built in conformance with the Society of Automotive Engineers' J1939 standard. Remote engine and bucket position control must be implemented in a way that cranking and shut down of the engine is effected only by closure of a hard-wired, ground side switch. This remote switch must be designed in the system hardware and be independent of the ESC's software. The hardware architecture cannot depend upon the ESC remaining active during engine cranking and must continue to function even if the ESC temporarily fails and reinitializes due to transient low voltage.

The status of the ESC cannot be allowed to interfere with normal starting and stopping of the engine using the standard four-position key ignition switch. It must remain possible to crank the engine even when the vehicle is latched in the remote start mode. This allows ground personnel to start the engine and engage PTO operation to lower a boom should the operator be disabled. It is permissible to allow momentary cycling of the key ignition switch to cancel remote stop mode. The system shall prevent engine cranking in response to closure of the remote switch if the hood is open. The hood disable feature must also be independently operable without reference to ESC status. However, the backup pump motor must be operable with the hood open.

The backup motor and solenoid should not be operated for any duration of time, or briefly cycled on and off, unless the conditions for emergency operation have been met. The backup motor brushes and solenoid contact life may be compromised by repeated, brief duration operation at high surge current levels. Remote switch operation should not result in application of any current to the backup motor and solenoid unless and until its operation is necessary.

The system shall permit the engine to crank only so long as the remote switch is closed. Once the remote switch opens, cranking should immediately stop, allowing only for some delay where the remote switch is pneumatically actuated. The system shall not allow the engine to crank unless the parking brake is set. This requirement can be met by modification of ESC software. The system shall not allow remote engine shut down unless a J1939 compliant engine RPM message is present on the vehicle databus from an engine controller. This requirement prevents stranding an operator in a boom since the engine will not crank remotely if an engine RPM message is not present.

SUMMARY OF THE INVENTION

According to the invention there is provided a motor vehicle having a remote switch by which the vehicle's engine may be shut down and restarted. In some applications the same switch may be used to engage a backup electric motor energized from the vehicle's battery as a substitute prime mover for a power take off apparatus installed on the vehicle. The invention provides a vehicle engine ignition control system having a starter solenoid and motor and engine control electronics. A multiple position ignition switch provides energization to the ignition control system in response to positioning of a key switch, as is conventional. The ignition switch has two output terminals which assume energized states in response to the positioning of the key switch. A first output is energized when the key switch in placed in a start position. A second output is energized when the key switch is in either the ignition position or the start position and may be energized when the key switch is in an accessory position. A remote switch is located on the vehicle away from the multiple position ignition switch, typically in a bucket suspended by an aerial boom. The remote switch provides a connection to ground when closed. An electrical systems controller communicates with the engine control electronics and is coupled to the remote switch to be responsive to closure of the remote switch in accordance with its programming. Responses include providing various enable signals and/or ground connections enabling operation of selected portions of the ignition control system. A remote start relay is coupled to respond to a remote start energization signal sourced by the electrical systems controller if it occurs concurrently with closure of the remote start switch. The remote start relay provides an activation signal on an output which is applied to a starter relay. The starter relay responds to the activation signal by providing activation energization to the starter solenoid and motor.

Remote stop of the engine is provided by control of a chassis ignition relay, which couples an ignition signal (Ign) from the ignition switch to an engine controller. A remote switch state detection relay is coupled to the remote switch and to-the second output of the multiposition ignition switch and is responsive to the concurrent occurrence of an energization signal on the second output of the multiposition ignition switch and closure of the remote switch to generate a remote stop energization signal. The electrical systems controller is further responsive to closure of the remote switch and to indication that the engine is operating (by reading an engine RPM signal from the engine controller) for providing a ground connection through an input. A remote stop relay provides coupling of energization from the multiple position ignition switch to the chassis ignition relay. The chassis ignition relay is connected to the remote switch state detection relay to receive the remote stop relay energization signal and is further connected to the input of the controller, the remote stop relay being responsive to the remote stop energization signal and grounding of the ground side of its energization coil through the controller input for interrupting energization of the chassis ignition relay and thereby cutting the Ign signal to the engine controller, resulting in interruption of operation of the engine.

Where a vehicle is equipped with backup prime mover for a vehicle power take off (PTO) apparatus, the ignition system further includes a backup motor and solenoid connected to the vehicle electrical power source. A backup motor inhibit relay is connected across the power connection to the backup motor and solenoid to prevent any undesired operation of the motor, however brief. A backup motor relay is coupled to receive energization from the remote start relay and is further coupled to the remote switch to be responsive to concurrent closure of the remote switch and application of the energization signal from the remote start relay for coupling energization signal from the remote start relay to the backup motor inhibit relay as an input. Finally the electrical systems controller provides a connection to ground on an inhibit input in response to the key switch being in the ignition position and engine cranking having been attempted and failed.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
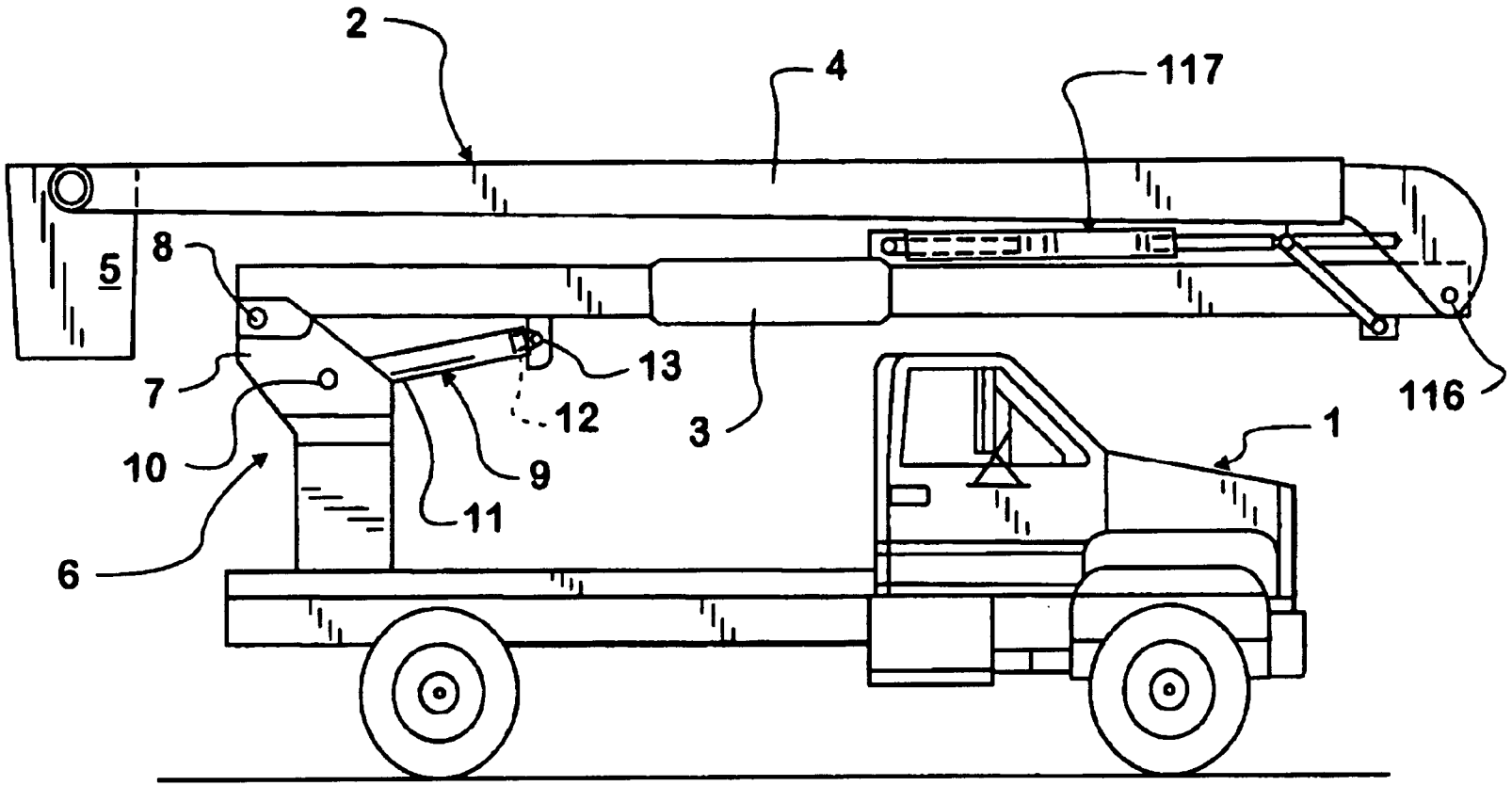
FIG. 1 is a simplified illustration of a truck mounted aerial lift assembly for locating an operator in various raised positions.

Referring to the drawings, and particularly to FIG. 1, an example of a mobile aerial lift truck 1 is illustrated in simplified presentation for clarity of illustration. The mobile aerial lift truck 1 includes an aerial lift unit 2 mounted to a bed on the back portion of the truck. The aerial lift unit 2 includes a lower boom 3 and an upper boom 4 pivotally interconnected to each other and to the truck bed through support 6 and rotatable support bracket 7. A bucket/basket 5 is shown secured to the outer end of the upper boom 4 within which the operating personnel are located during the lifting to and locating within a selected work area in accordance with known practice. Basket 5 is typically pivotally attached to the out end of the boom 4 to maintain a horizontal (level) orientation at all times. The aerial lift unit 2 is mounted to the truck bed through support 6. A rotatable support bracket 7 is secured to the support 6 and projects upwardly. The lower boom 3 is pivotally connected as at pivot 8, to the rotatable support bracket 7. A lifting lower boom cylinder unit 9 is interconnected between bracket 7 and the lower boom 3. In the illustrated embodiment, a pivot connection 10 connects the lower boom cylinder 11 of unit 9 to the bracket 7. A cylinder md 12 extends from the cylinder 11 and is pivotally connected to the boom 3 through a pivot 13. Lower boom cylinder unit 9 is connected to either of two hydraulic supplies of a suitable hydraulic fluid, which allow the assembly to be lifted and lowered as desired.

The outer end of the lower boom 3 is interconnected to the lower and pivot end of the upper boom 4. A pivot 116 interconnects the outer end of the lower boom 3 to the pivot end of upper boom. An upper boom compensating cylinder unit or assembly 117 is connected between the lower boom 3 and the upper boom for pivoting the upper boom about pivot 116 for positioning of the upper boom relative to the lower boom. The upper boom/compensating cylinder unit 117 is constructed to permit independent movement of the upper boom 4 relative to boom 3 and to provide a compensating motion between the booms to maintain the upper boom raising with the lower boom and is similarly connected to the sources of pressurized hydraulic fluid as further developed below. Conventionally, aerial lift unit 2 requires positive hydraulic pressure both to be lifted or to be lowered. Bucket 5 includes a plunger moving a piston in an air line. The air line runs from bucket 5 to a point on truck 1 where a remote switch, as described below, is located.

Figure 2:
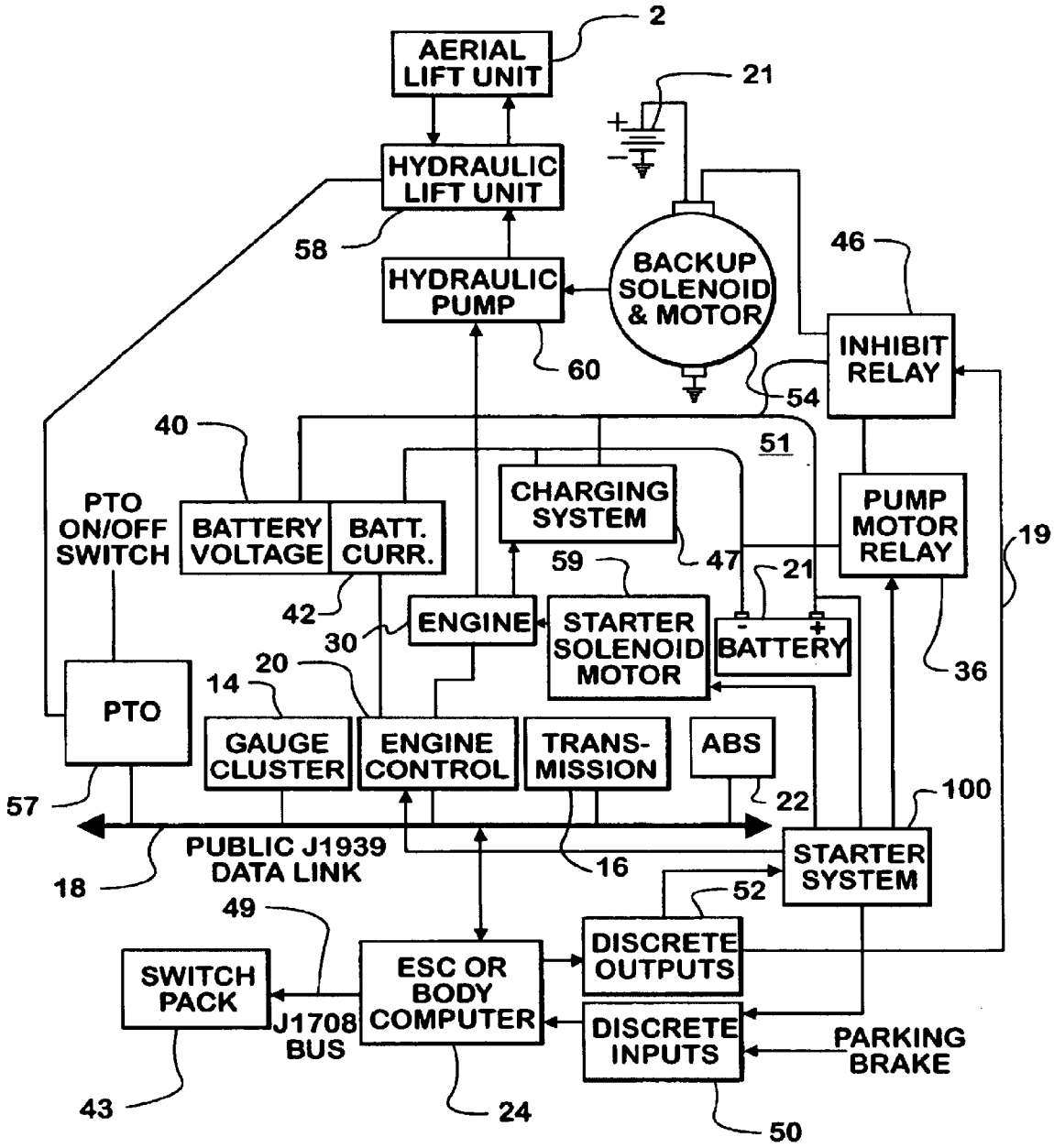
FIG. 2 is a high level schematic of a vehicle electrical and hydraulic control system incorporating the invention for the truck of FIG. 1.
Figure 3:
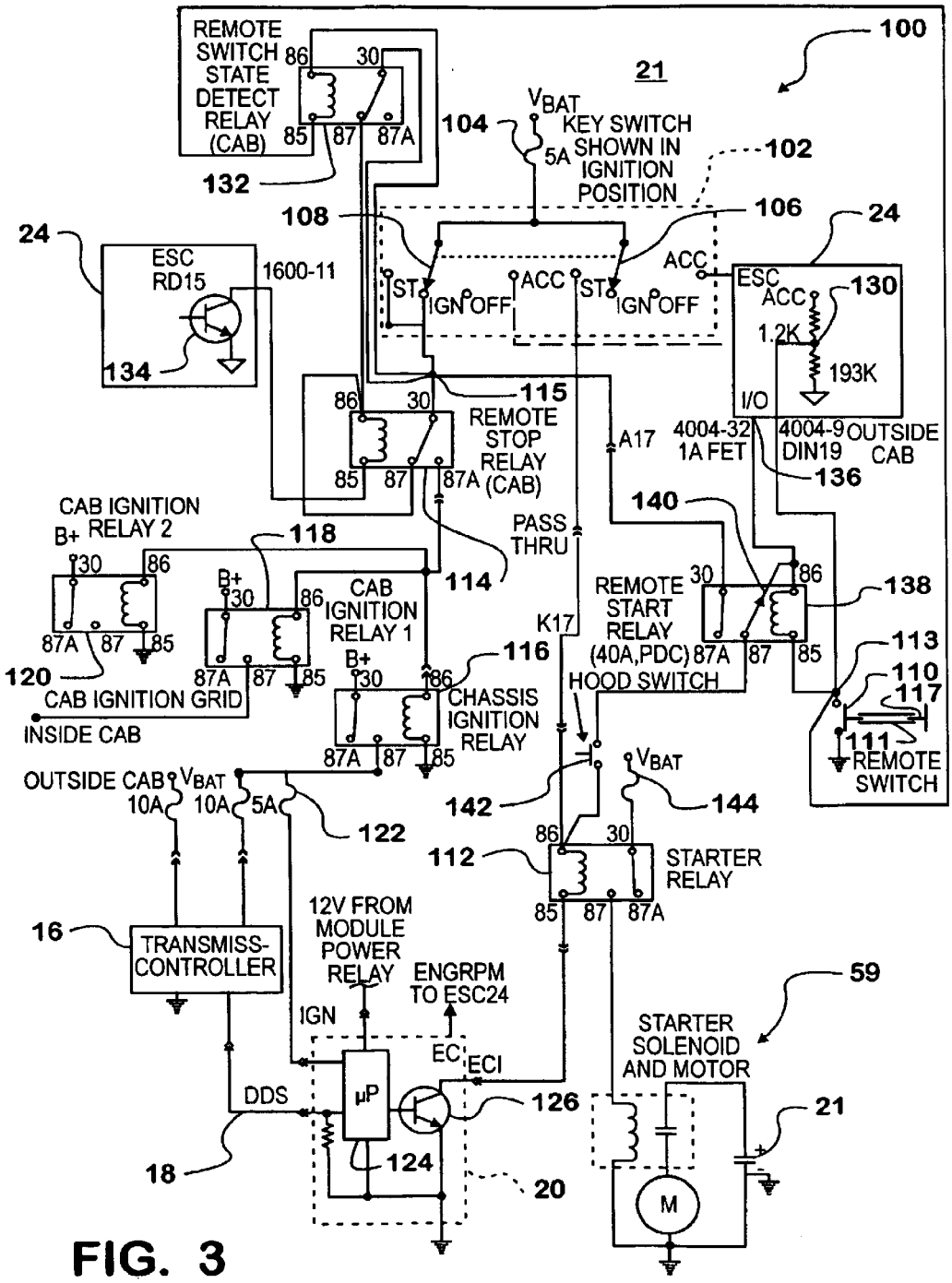
FIGS. 3–10 are a series of circuit schematics of a remote ignition control system in accordance with two embodiments of the invention.

FIG. 2 is a block diagram schematic illustrating electronic control of a truck 1, based on controller area network technology and an electrical systems controller/body computer (ESC) 24. Collectively, bus/data link 18 and the various nodes (generally the various vocational controllers described below) to which it is attached form the controller area network (CAN), which conforms to the SAE J1939 standard. Controller area networks are networks which do not have destination addresses for nodes attached to the networks, but rather provide for transmission of data in packets, identified as to the source, message type and priority. The nodes are programmed as to whether to respond to a packet based on one or more of three identifiers. Many message types are predefined by the SAE J1939 standard. The SAE J1939 standard: allows the definition of proprietary message types which in structure conform to the standard.

Active vehicle components are typically controlled by one of a group of autonomous, vocational controllers. These vocational controllers include ESC 24, an engine controller 20, a electrical gauge controller 14, a transmission controller 16, an anti-lock brake system controller 22, and a remote power take off controller 57. ESC 24 and engine controller 20 are of primary interest to the present invention. Transmission controller 16 is provided with vehicles equipped with automatic transmissions and generates a signal indicating whether the vehicle's drive line is engaged or not. It is preferred at the time this application is being written that application of the invention be limited to vehicles equipped with automatic transmissions due to the lack of a indicator on vehicles equipped with standard transmissions as to whether the vehicle drive line is disengaged. Should such an indicator be made available the invention can be used on vehicles equipped with standard transmissions. Engine controller 30 provides an engine RPM signal, which is required for implementing certain routines in ESC 24. The engine controller 20 also receives certain signals implicated in engine operation. ESC 24, through discrete input ports 50 and output ports 52, provides selective enable signals and ground connections, and detects the state of a remote switch used for remotely starling and stopping the vehicle's engine.

The hydraulic lift unit 58 which supports operation of an aerial lift unit 2 is primarily powered by a conventional PTO hydraulic pump 60 which is usually driven by engine 30. Backup to engine 30 for powering hydraulic pump 60 is provided by a backup solenoid and motor 54, energized from vehicle battery 21. Energization of backup solenoid and motor 54 is controlled in part by programming of ESC 24 and control signals issued by it through discrete outputs 52 coupled into the starter system 100 and a pump inhibit relay 46. Energization for backup solenoid and motor 54 is supplied by battery 21 as controlled by a pump relay 36 and the pump inhibit relay 46. ESC 24 also controls remote starting and stopping of engine 30 by control signals provided to starter system 100 which in turn provides control signals to a starter solenoid and motor 59 and engine controller 20. Battery 21 charge is maintained by an engine 30 driven charging system 47. ESC 24 also monitors the position of a parking brake and a PTO on/off switch. PTO on/off switch is located in a multiplexed switch pack 43, monitored on the J1708 switch data link 49. The parking brake is a discrete switch input 50.

Referring to FIGS. 3–7, a preferred embodiment of the starter system 100 as applied to a vehicle not having a backup hydraulic pump motor is illustrated. Starter system 100 provides for starting and stopping an internal combustion engine 30 from either inside a vehicle cab using an ignition switch 102 or from a remote point on the vehicle using a remote switch 110. Remote switch 110 is a ground side, momentary contact switch with a default open state. Remote switch 110 is pneumatically actuated using a plunger 117 into an air line 111. Ignition switch 102, as is conventional, has four position: (1) accessory/Acc; (2) off; (3) ignition; and (4) start. Ignition switch 102 has first and second mechanically linked switches 106 and 108. Switch 106 has an output connected to the start contact of the switch. For switch 108 the ignition and start position are tied together for output 115. Ignition and Accessory/Acc positions are tied together when the key switch is either of these positions. Accessory/Acc is a discrete input to the ESC 24. Acc has +12V anytime the key is in the accessory or ignition positions. Accessory drops out with the key switch in the crank position, which permits the invention to detect that the key switch is in the crank position during a remote stop period, such as the case where someone in the cab cranks the engine should the operator in the boom not be able to start the engine remotely (e.g. when the operator is unable to press the remote button. Switch 108, as described below, allows for remote stopping and starting of an engine using remote switch 110. Ignition switch 102 is key actuated and is energized through a 5 amp fuse 104 from battery 21. For clarity of presentation, the off and ignition contacts for switch 106 are shown as floating, their operation not effecting the invention. The accessory contact of switch 106 provides power as an input to the ESC 24.

Remote switch 110, ignition switch 102 and the various relays used in implementing starter system 100 interact with programmable controllers which communicate with one another over the J1939 datalink 18. ESC 24 and engine controller 20 monitor the state of various signals and provide enabling signals (including signals characterized by a ground connection through the controller) which implement aspects of the invention. Transmission controller 16 provides a driveline engagement indication signal used by engine controller 20 which inhibits cranking should the transmission engagement signal indicate the transmission (not shown) is in neutral or park. Some operations of starter system 100 can however be invoked notwithstanding temporary failure of the programmable controllers. ESC 24 is illustrated sectioned into two parts, one associated with electrical connections outside of a vehicle cab and a second section inside the vehicle cab. ESC 24 is usually one device and the division is simply for convenience of illustration. Adapting starter system 100 for remote operation must be done in a way that does not change normal operation of a vehicle. Accordingly, switch 106, when moved to the start position, supplies power to a sense input (PIN 86) of starter relay 112. This causes starter relay 144 to close thus supplying power from battery 21 through fuse 144 to the output associated with PIN 87 of the starter relay and from there to a starter solenoid and motor 59. Engine controller 20 provides a ground to PIN 85 of starter relay 112 through a transistor switch 126 which is biased into conductivity in response to a gate signal provided by microprocessor 124.

Remote operation is possible when ignition switch 102 is placed in the "ignition position". This places both of switches 106 and 108 in the ignition position, supplying power to node 115 which is tied to the second output of ignition switch 102. Remote operation is invoked by closing momentary contact remote switch 110, the effect of which is to connect to ground node 113, which is normally biased high by ESC 24 from a sensor input 130. The closure of remote switch 110 is detected by ESC 24 through sensor input 130. The closure of remote switch 110 also grounds the ground side contact for the sense coil of a remote start relay 138 and the ground side contact for the sense coil of a remote switch state detect relay 132. Assuming initially that engine 30 is running, the closure of remote switch 110 results in engine 30 being shut down. Since switch 108 is in the ignition position power flows from node 115 to the high side contact for the sense coil for remote switch state detect relay 132, and the relay closes, supplying power from ignition switch 102 through remote switch state detect relay 132 to the high side sense input of remote stop relay 114.

Upon detection of closure of remote switch 110 ESC 24 determines if the conditions for remote stop are present, e.g. (1) parking brake set, (2) Engine RPM signal non-zero, etc.

It all the conditions are met, ESC 24 will provide a ground connection through transistor 132 (an RD15 low side driver) to the low side contact for the sense coil of remote stop relay 114, resulting in the relay opening and the transfer of power through the remote stop relay being interrupted. When remote stop relay 114 opens, three ignition relays 116, 118 and 120 are all interrupted, with the result that power to all ignition powered features of the vehicle are interrupted. Chassis ignition relay 116 provides an ignition signal (Ign) via fuse 122 to engine controller 20 and microprocessor 124. Engine controller 20 in turn carries out a shut down of engine 30. Power is also interrupted to transmission controller 16.

When the user releases remote switch 110, DIN 19 on ESC 24 detects an increase in voltage at node 113 indicating to ESC 24 that the remote switch has opened. Remote switch state detect relay 132 is deenergized due to loss of a connection to ground on the low side of the switch state detect relays sense coil. Remote stop relay 114 remains energized (i.e. latched) because the high side of the remote stop relay sense coil is bed to DIN 87 of the relay and ESC 24 continues to provide a ground connection to the low side of the remote stop relay's coil.

Figure 4:
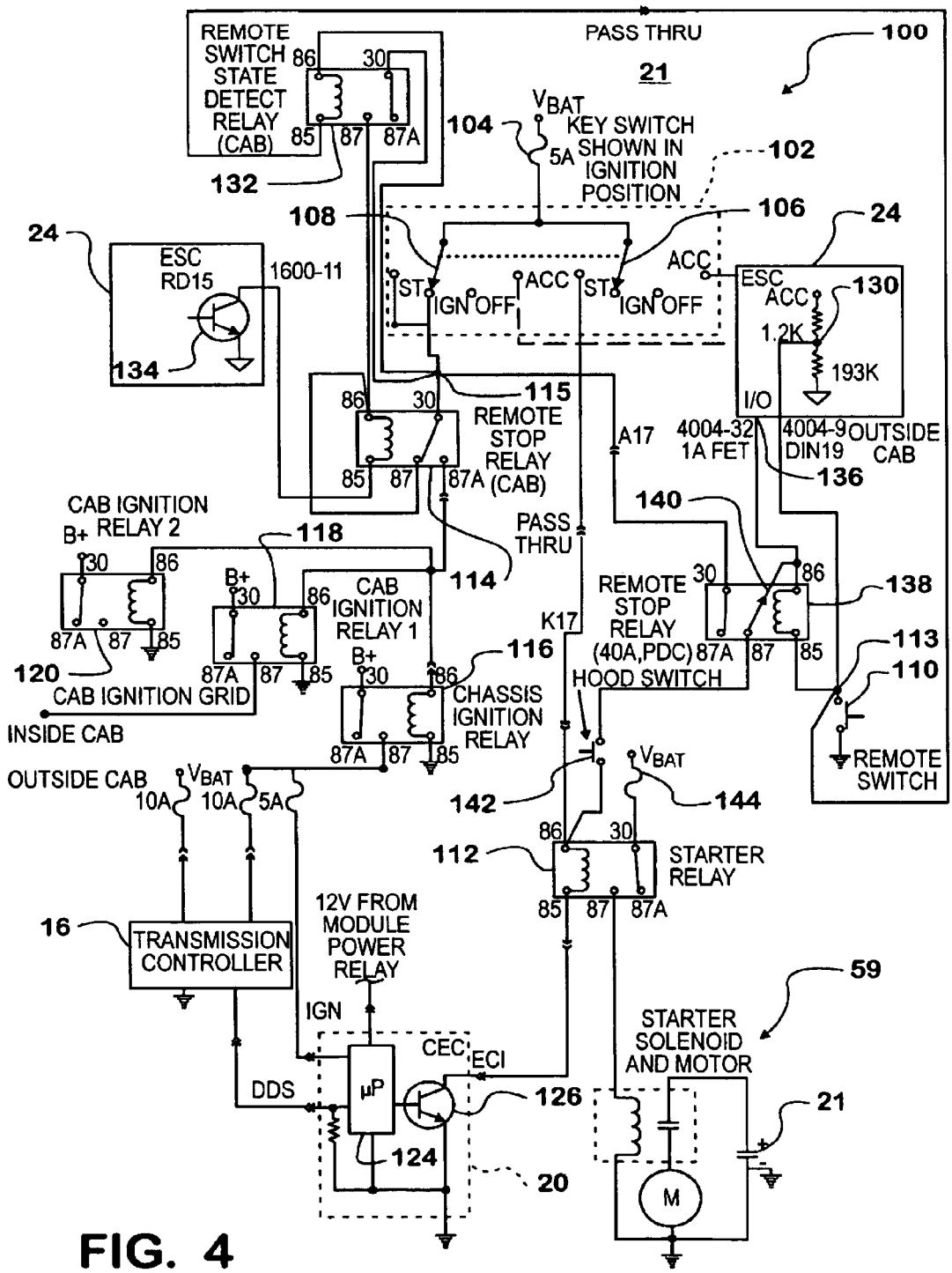
Figure 5:
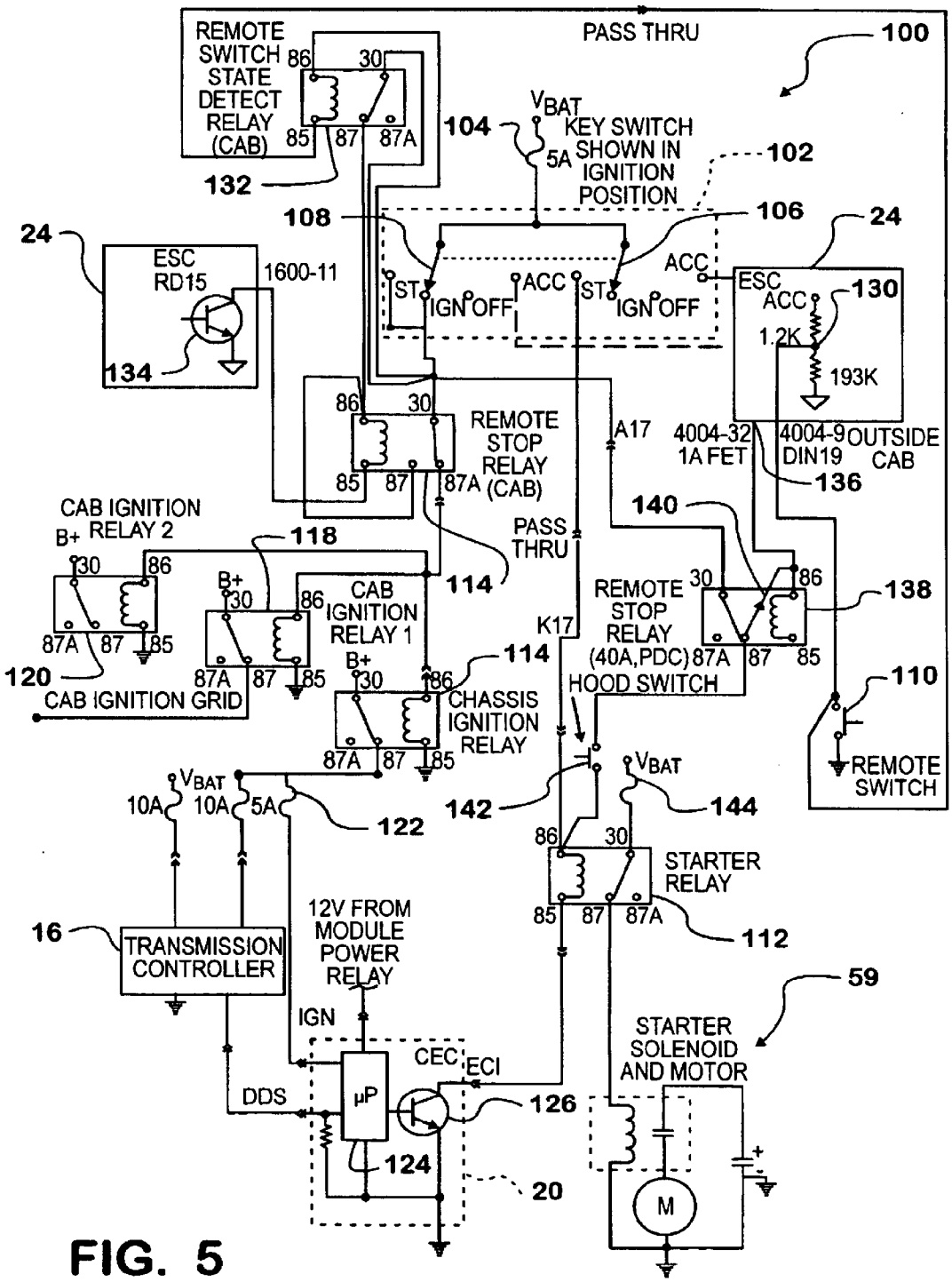
Figure 6:
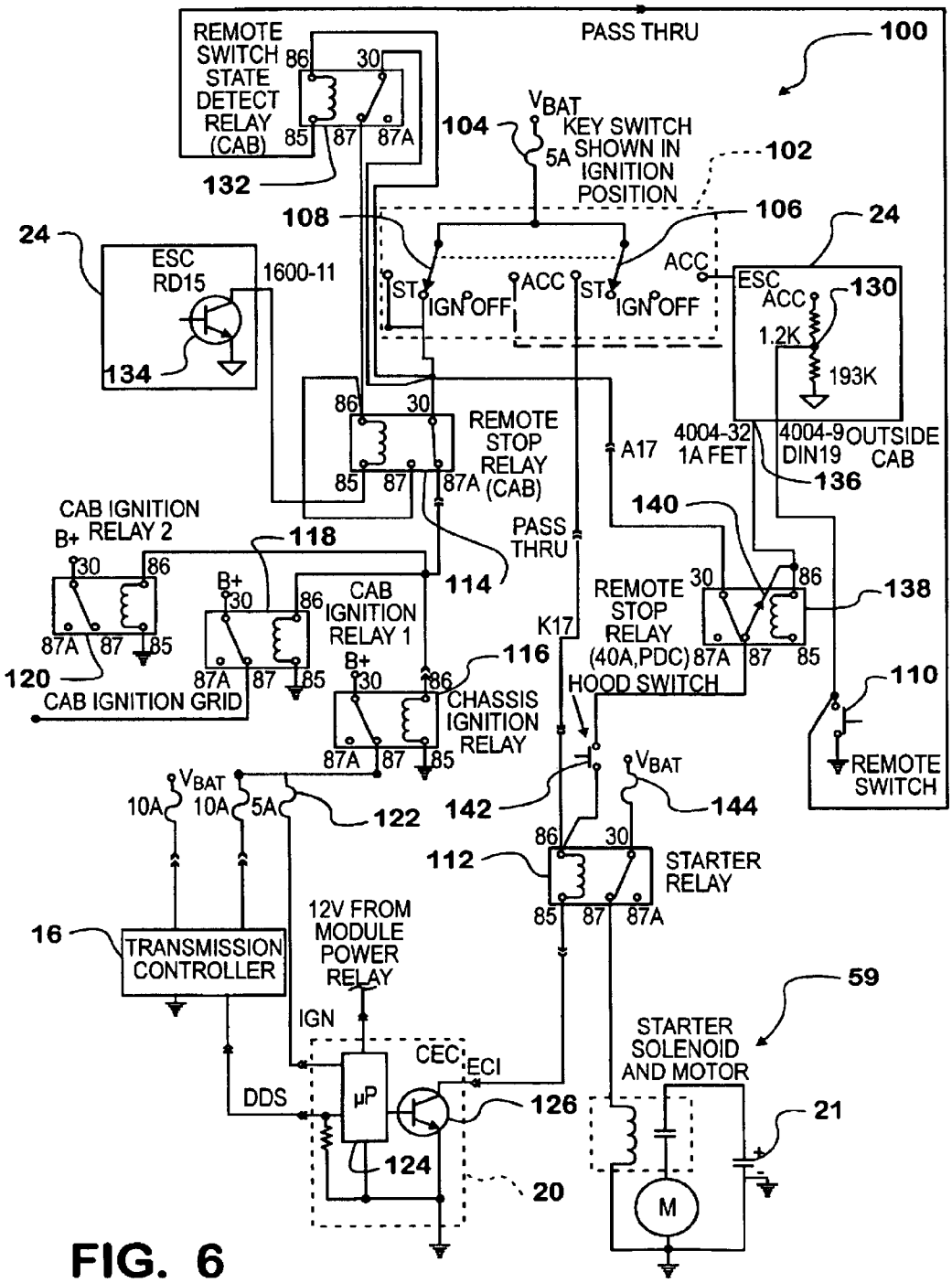
Figure 7:
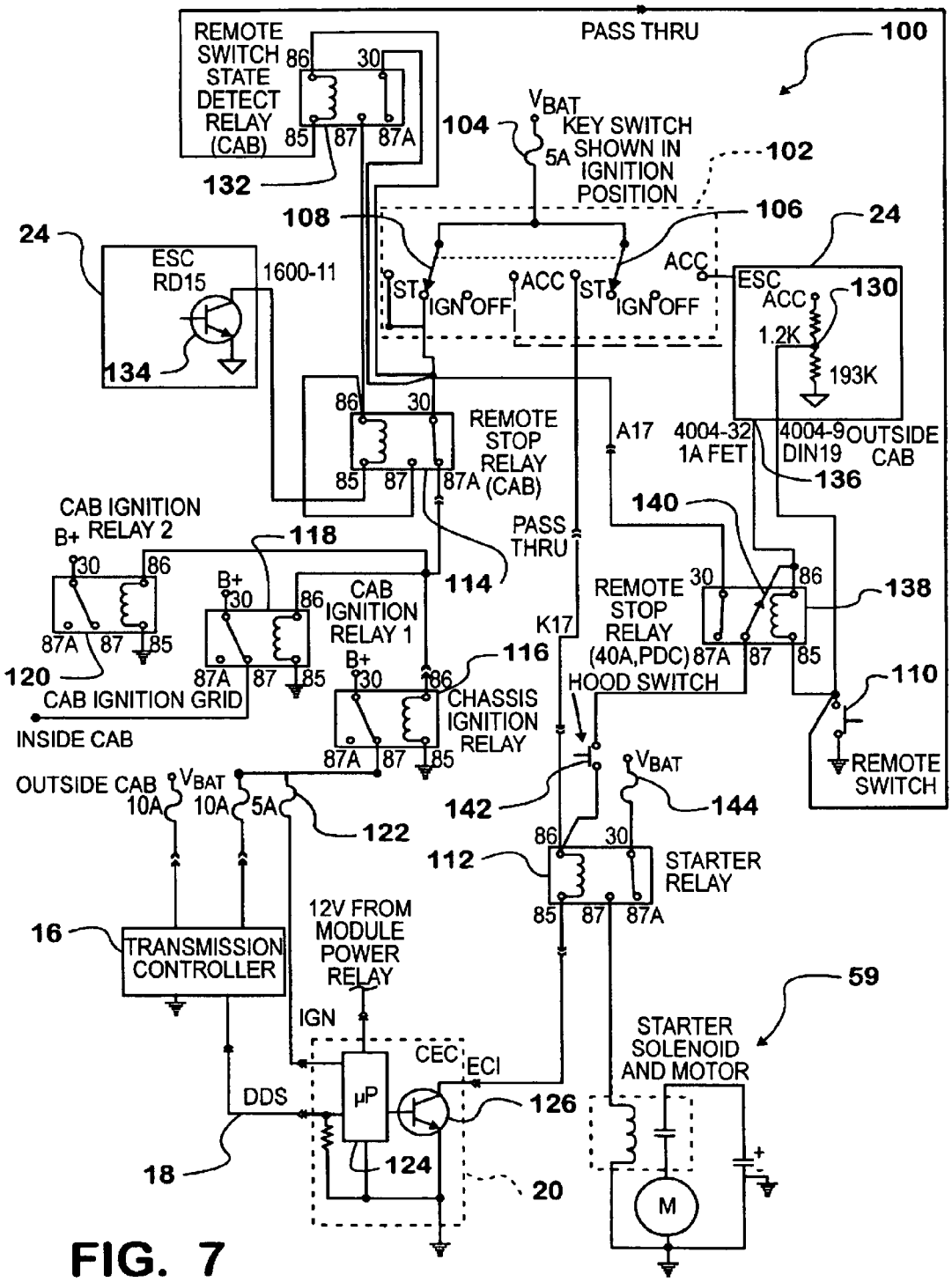

Remote start is explained with reference to FIG. 4. Again a user causes remote switch 110 to close and holds the remote switch down. Engine 30 cranks for as long as remote switch 110 is held closed. Upon closure of remote switch 110 node 113 drops to ground, an event which is detected by sensor 130 (DIN 19) of ESC 24. The voltage drop causes remote switch state detect relay 132 to trip to a closed state, an operation which has no other effect on circuit operation. In response to the fall in voltage ESC 24 determines if the conditions for remote start are met. If the conditions are met, ESC 24 removes the gate voltage from transistor 134 cutting off conduction through the device. At this point the remote stop relay 114 deenergizes, reconnecting the high sides of the energization coils for the three ignition relays 116, 118 and 120, to power from multiple position ignition switch 102. The low side contacts for the sense coils for all three of the ignition relays 116, 118 and 120 are connected permanently to chassis ground so all three relays are automatically reenergized. The signal Ign to engine controller 20 is thus restored and transistor 126 is energized to connect the ground side of the energization coil of starter relay 112 to ground. Ign also indicates to the engine controller 20 that other ignition management functions are to be implemented.

ESC 24 must carry out certain actions to enable an engine restart in response to closure of remote switch 110. The response to the detected voltage drop on node 113 includes ESC 24 driving output 136 high. With output 136 high and node 113 low, a voltage difference appears across the contacts of the sense coil for remote start relay 138 and the relay becomes energized. Provided the vehicle hood is closed (thus dosing a hood safety switch 142), power will be coupled through remote start relay 138 to the sense coil high side input (DIN 86) of starter relay 112 from node 115 with the key switch of the multiple position ignition switch 102 in the ignition (Ign) position. With starter relay 112 energized, energy is coupled through the starter relay from battery 21 to starter solenoid and motor 59 to initiate cranking.

High surge currents delivered to starter solenoid and motor 59 may cause a system voltage drop which may result in ESC 24 resetting. If this occurs transistor 134 remains in a non-conductive state which is desired. However, output 136 can fail. Accordingly, it is desirable to provide a means of latching remote start relay 138 in an energized state for cranking, since cranking will cease if remote start relay 138 deenergizes in response to loss of the signal from output 136. See FIG. 6. To effect latching of remote start relay 138 a diode 140 is provided oriented to conduct electricity from DIN 87 (the normally open contact) of remote start relay 138 to the high side contact of the energization coil for the relay. Once remote start relay 138 is energized, and for as long as remote switch 110 is closed, the relay will remain latched by way of a forward biased diode 140. This of course requires the ignition switch 102 remain in the Ign or St position. If Ignition switch 102 is moved to the OFF position, it will of course deprive the output DIN 87 of power and remote start relay 138 will be deengergized. Release of remote switch 110 deprives the ground side contact of the energization coil of the remote start relay of a ground connection also resulting in deenergization of the relay. See FIG. 7.

A diode 140 is used instead of a wire connection to provide a latch mechanism for remote start relay 138. Were a wire used to connect the contacts of remote start relay 138, anytime a high signal appeared on output 136 of ESC 24 the engine would crank. Since ESC 24 is subject to reprogramming and field maintenance the possibility that the device could be reprogrammed or rewired cannot be discounted. The engine crank inhibit low side driver (sensor input 130) is a relatively low impedance path to ground from node 113 when the transmission Is in neutral. It could function to pull down node 113 enough to be detected as closed remote switch.

Figure 8:
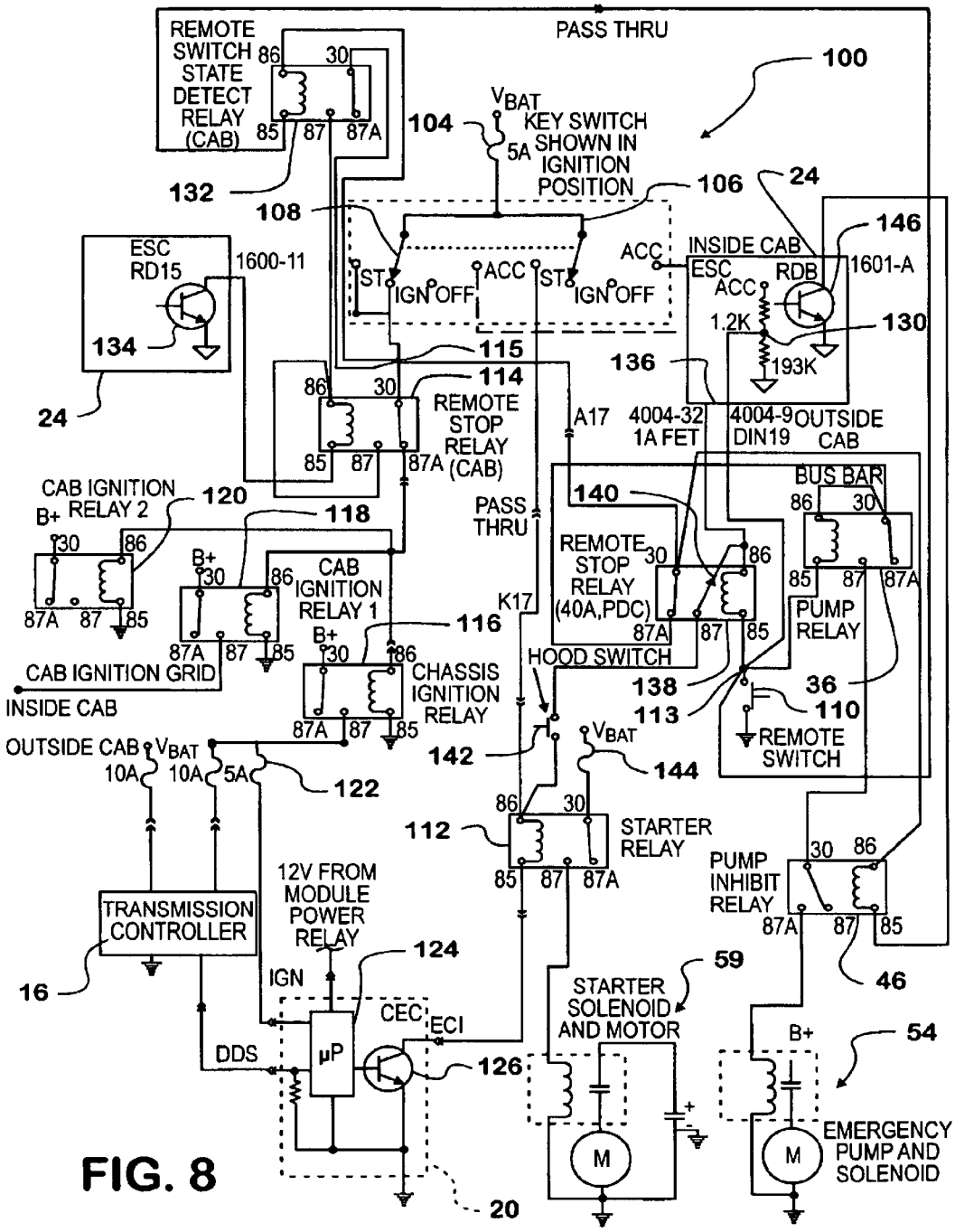
Figure 9:
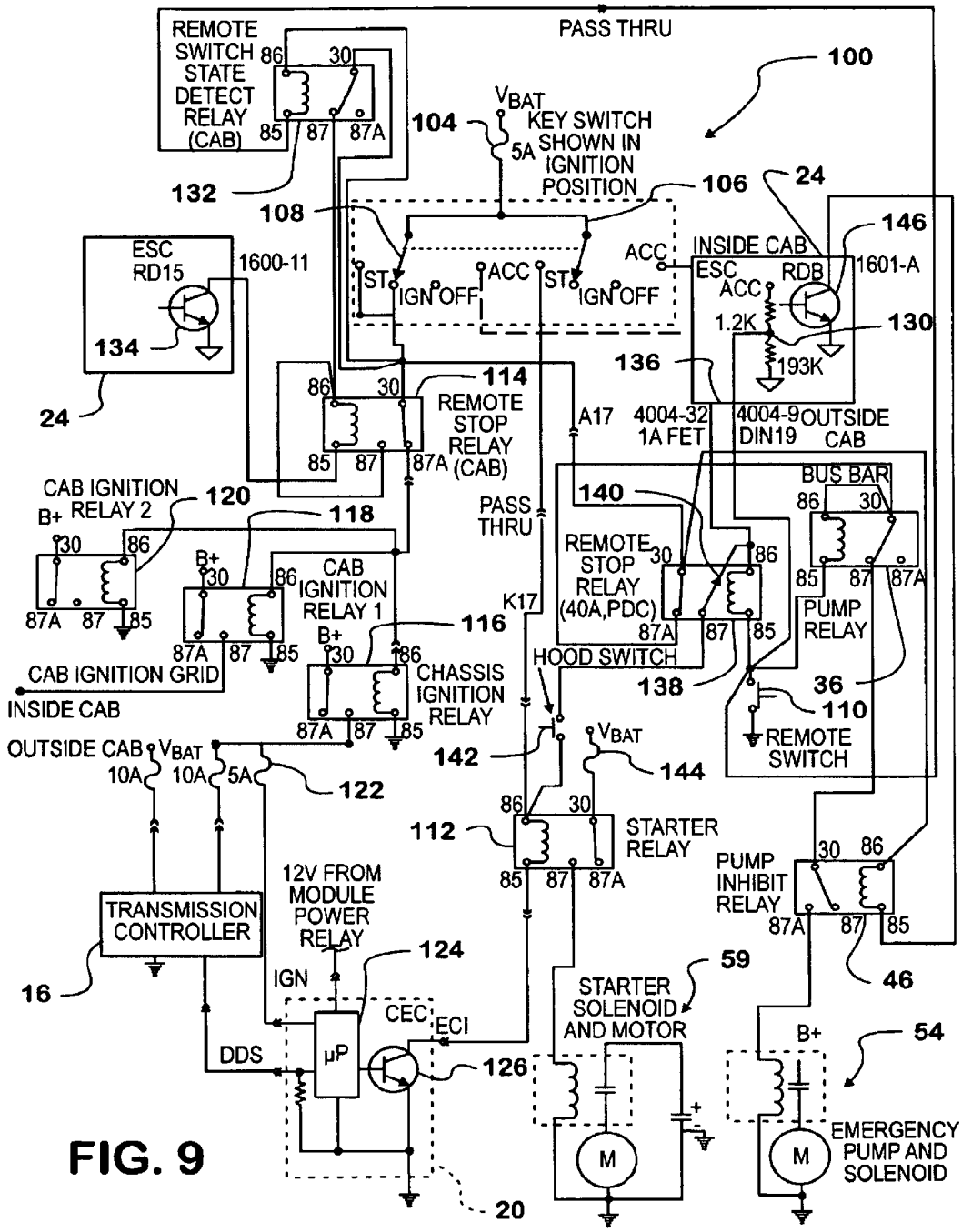
Figure 10:
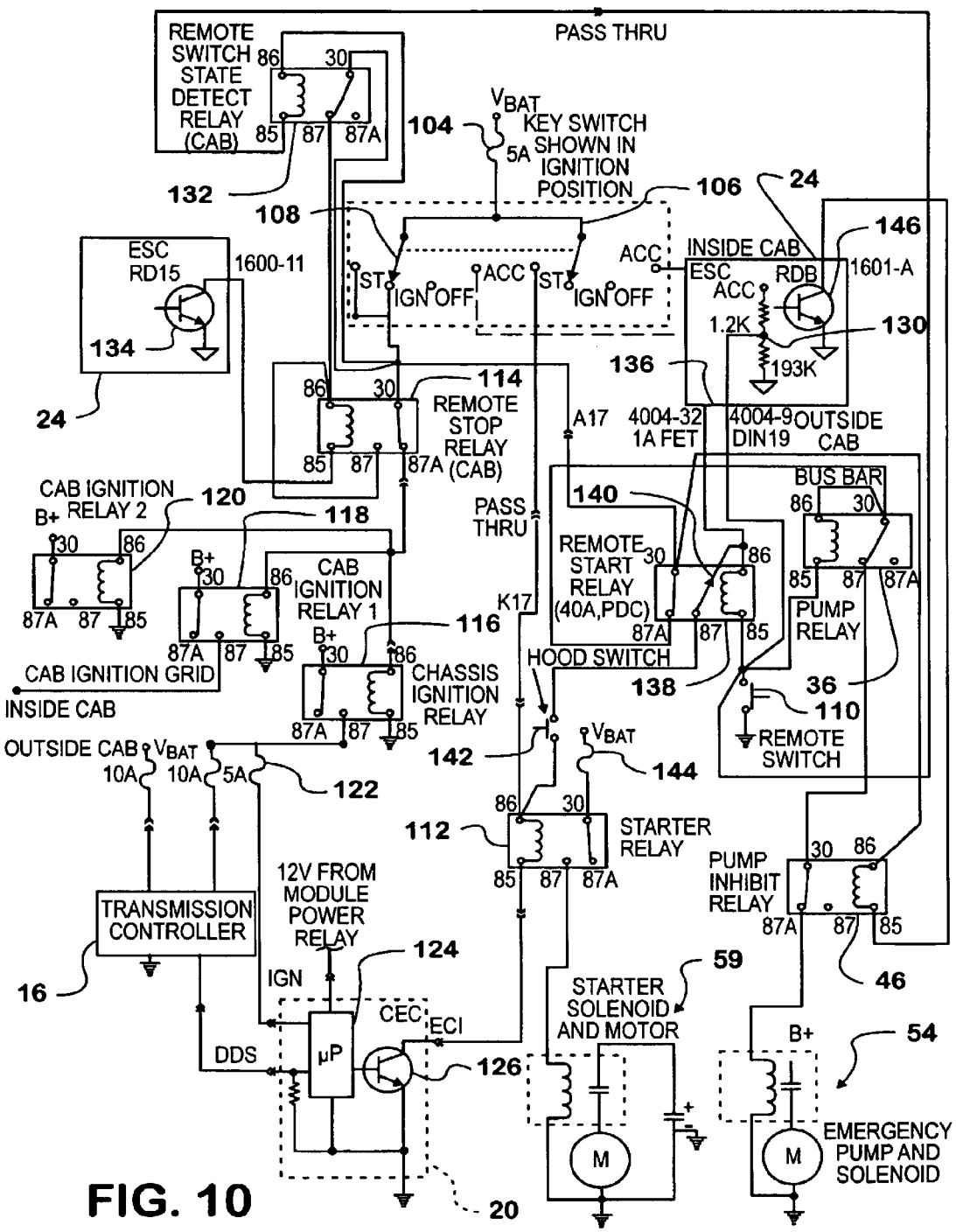

Referring to FIGS. 8–10 a second embodiment of the invention incorporating an emergency pump motor and solenoid 54 is described. The remote start/stop circuit 100 of FIGS. 3–7 is unchanged except for the addition of the emergency motor and associated control relays. As with the remote start operation, operation of the emergency motor is to be invoked using remote switch 110. An additional connection to ESC 24 is also provided to allow ESC 24 a certain degree of control over remote operation of emergency pump motor and solenoid 54 although the circuit provides for failsafe operation of the emergency pump motor should ESC 24 fail.

Normally the operation of emergency pump motor and solenoid 54 is inhibited by ESC 24. This is effected by ESC 24 energizing transistor 146 to provide a pump inhibit signal (a ground contact) to the low side contact of the energization coil of pump inhibit relay 46. The high side contact of the energization coil of pump inhibit relay 46 is connected to node 115. As a result, pump inhibit relay is energized and no activation signal can flow from the relay to emergency pump and solenoid 54. See FIG. 8.

Emergency pump operation following a remote stop occurs when a user/operator keeps remote switch 110 depressed after a remote engine shut down. Remote start relay 138 is not energized, so ignition voltage is supplied from multiple position ignition switch 102 via node 115 to the high side sense coil contact of pump relay 36 energization coil and to the power input contact of the pump relay, the two contacts being in common. See FIG. 9. With the ground side contact of the energization coil of pump relay 36 at ground, the response of pump relay 36 is to energize supplying power to DIN 30 (common terminal) of pump inhibit relay 54.

ESC 24 times the duration of closure of remote switch 110 and when three seconds have expired deenergizes transistor 146 depriving a connection to ground for the ground side contact of the energization coil of pump inhibit relay 46. Pump inhibit relay 46 deenergizes connecting the common terminal of the relay to output DIN 87A and thereby supplying an activation signal to emergency pump motor and solenoid 54. See FIG. 10. The deenergized pump inhibit relay 46 supplies ignition voltage to the emergency pump motor solenoid resulting in energization of the emergency pump motor. Emergency pump motor and solenoid 54 operates as long as remote switch 110 is held closed. Opening remote switch 110 causes pump relay 36 to deenergize, interrupting the signal to the common terminal of pump inhibit relay 46 which in turn deenergizes depriving emergency pump motor and solenoid 54 of an activation signal. In addition, when remote switch 110 is released the voltage on node 113 increases, which is detected by ESC 24 which responds by energizing transistor 146 and thereby energizing pump inhibit relay 46 until ESC 24 again determines that the conditions for emergency pump motor operation are met. Were there no pump inhibit relay 46, any closure of remote switch 110 would cause emergency pump motor and solenoid 54 to briefly operate, which has the potential of decreasing the life of the solenoid and motor.

Operation of emergency pump motor and solenoid 54 can also occur after an unsuccessful engine crank. ESC 24 maintains pump inhibit relay 46 in an energized state until the conditions for emergency pump motor and solenoid 54 operation are met. Following a crank attempt which fails, an operator releases remote switch 110 to discontinue cranking. The operator then depresses remote switch 110 and holds it closed to initiate operation of the emergency pump motor and solenoid 54. See FIG. 9. ESC 24 will detect the closed remote switch 110. Even though the engine is not running, ESC 24 does not initiate a crank operation (by supplying the appropriate signals at output 136 and changing the state of transistor 134) since the last command was to crank the engine. ESC 24 is programmed instead to engage emergency: pump motor and solenoid 54 following a failed cranking attempt, even if ESC 24 suffered a reset due to low battery voltage during cranking. Three seconds after remote switch 110 is closed ESC 24 deenergizes transistor RD13 146. This in turn deenergizes pump inhibit relay 46. Closure of remote switch 110 has already supplied a ground connection to the ground side contact of the energization coil of pump relay 36, resulting in the pump relay becoming energized. Deenergized pump inhibit relay 46 supplies ignition voltage from pump relay 36 to emergency pump motor and solenoid 54 and the emergency pump motor begins to operate until remote switch 110 is released. Opening of remote switch 110 causes pump relay 36 to deenergize, interrupting ignition voltage to pump inhibit relay 46 and cutting off power to emergency pump motor and solenoid 54. Pump inhibit relay 46 remains energized by a reenergized RD 13 transistor 146 until the conditions for emergency pump motor operation are again met.

Emergency pump motor and solenoid 54 operation are also available in case of a complete failure of ESC 24. If ESC 24 fails, the pump inhibit signal from RD 13 transistor 146 also fails and the pump inhibit relay 46 deenergizes. If battery voltage is still available, ignition voltage is still present on the high side contact and common contact for the energization coil of pump relay 36. When remote switch 110 is depressed pump relay 36 energizes and couples ignition voltage through to the common contact of now deenergized pump inhibit relay 46. Pump inhibit relay couples the ignition voltage through to emergency pump motor and solenoid 54 which is energized whenever, and for as long as, remote switch 110 is closed. No three-second delay occurs for pump operation under conditions of failure of ESC 24.

Figure 11:
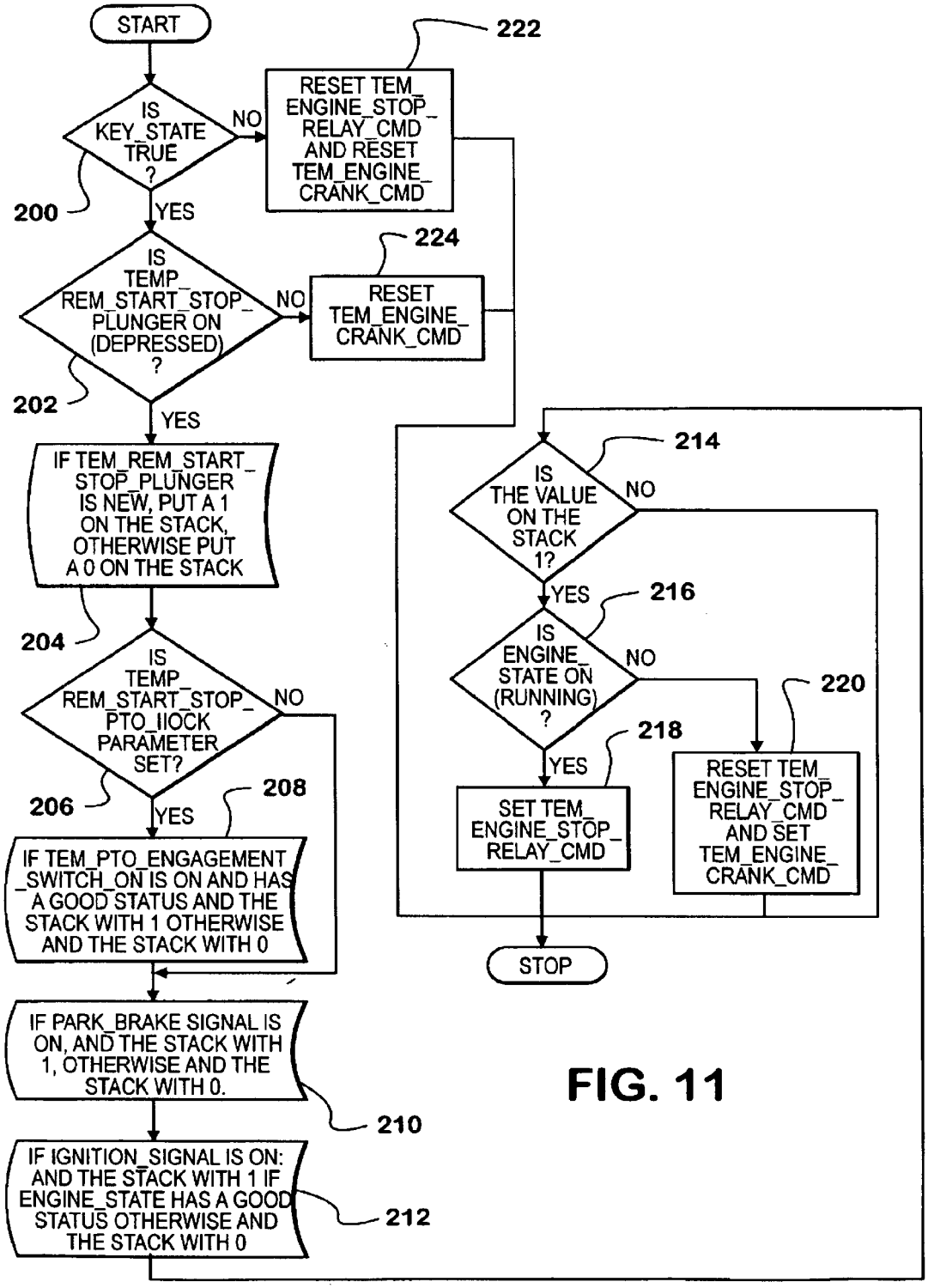
FIGS. 11–12 are high-level flow charts of programs executed by a system electronics controller in implementing aspects of the invention.
Figure 12:
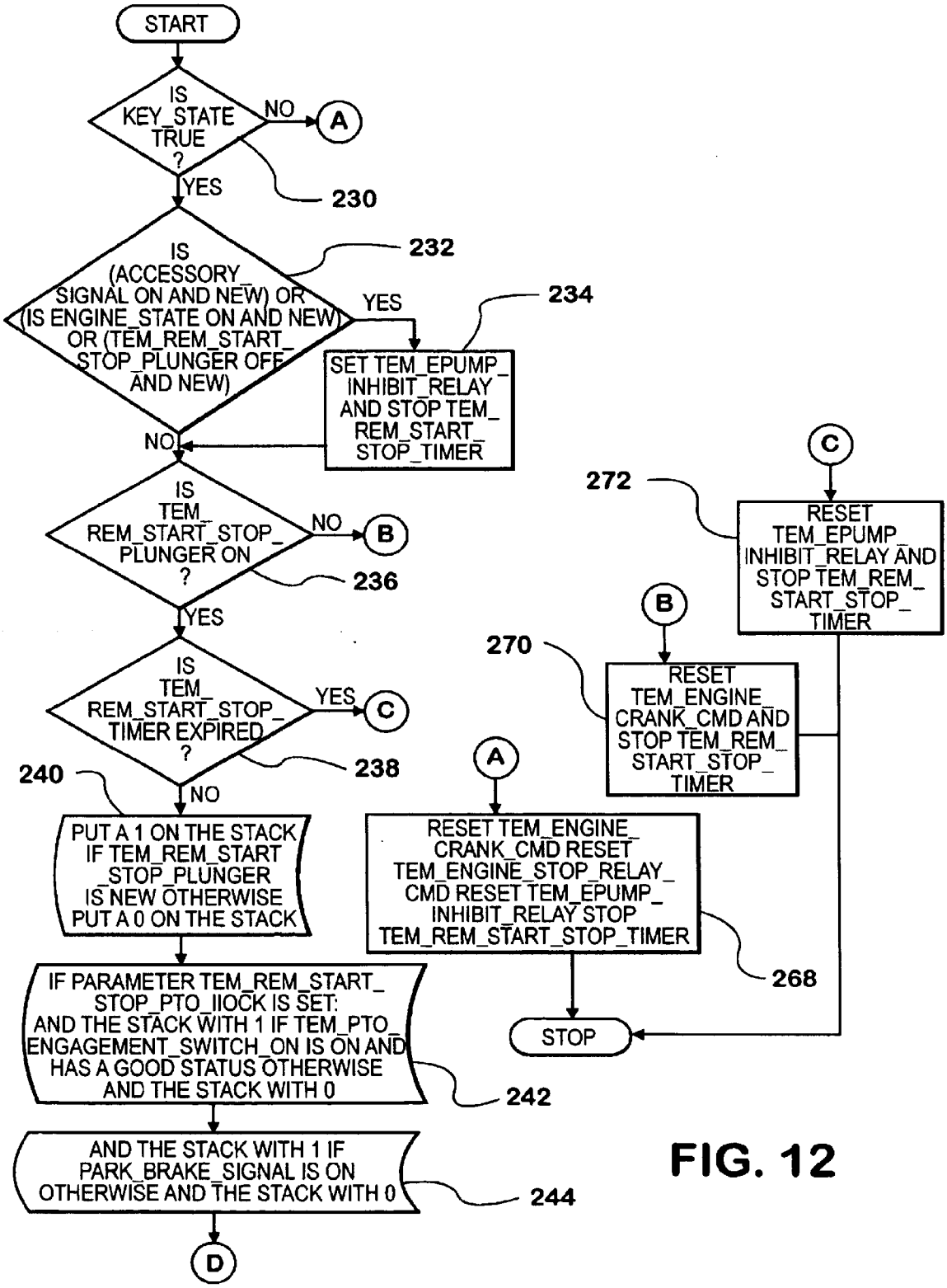
Figure 12A:
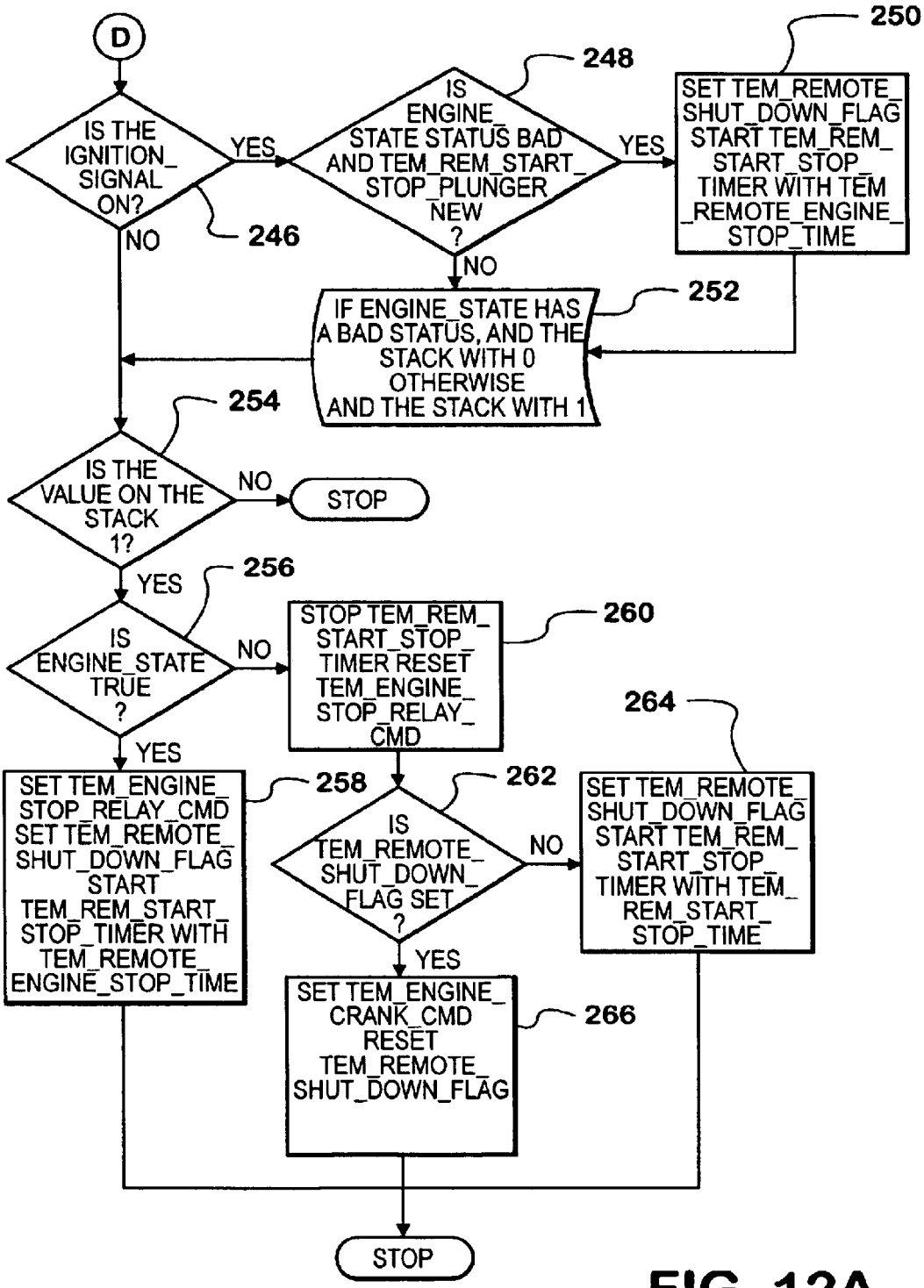

FIGS. 11 and 12 are flow charts for programming of ESC 24 to implement certain features of the present invention for the embodiment not incorporating and the alternative embodiment incorporating an emergency pump motor, respectively. The programs implement logical testing for the conditions under which the vehicle's engine is stopped or started and the emergency pump motor is run. When the conditions for an engine stop are met ESC 24 provides the required signals for invoking particular operations. For example, for a remote engine stop, a 1 amp FET low side driver associated with ESC output 136 is deactivated and remote stop relay 114 is activated and remains activated until either multiple position ignition switch 102 is moved to OFF or an engine crank sequence has begun. For a vehicle equipped with an emergency pump motor the remote stop relay 114 remains activated until the ignition switch is turned to off, or the remote switch 110 is held closed for a period exceeding a delay period, or an engine crank is requested. Programming helps determine if the conditions for an engine stop are met, which are: (1) the engine is running; (2) the multiple position ignition switch is NOT in the OFF position; (3) remote switch 110 is depressed; (4) the remote switch 110 has just been depressed; (5) the park brake is set; (6) the status of the engine speed message signal is good; and (7) if a PTO interlock variable is set, the PTO switch is on and has good status. Where the vehicle is equipped with an emergency pump motor then the last condition (no. 7) is simply that the status of the engine speed signal is good. When the engine controller determines that the engine has started it discontinues cranking.

The engine can be remotely started under the following conditions: (1) The engine is not running; (2) the key is not in the OFF position; (3) the plunger switch is depressed; (4) the plunger switch has just been depressed; (5) the parkbrake is set; and (6) if the PTO interlock is set, then the PTO switch is on and has good status. For a vehicle with an emergency pump motor condition 6 is replaced with the condition that: the previous sequence with the engine not running was an emergency pump motor operation sequence or the previous sequence was an engine stop sequence using remote switch 110.

Emergency pump motor inhibit relay 46 is activated when ignition switch 102 is not in the off position and any one of the three following conditions is met: (1) the accessory signal is ON and NEW, or (2) the engine state is ON and NEW, or (3) the remote switch 110 has just been released. Pump inhibit relay 46 is deactivated when the ignition switch 102 is OFF or all of the following conditions are met: (1) ignition switch 102 is not OFF; (2) remote switch 110 is closed; (3) remote switch 110 has been dosed for longer that the programmed delay period after stopping the engine to run the emergency pump motor 59. Finally, it an emergency pump motor is present it will also run if the multiple position ignition switch 102 is not in the OFF position, the remote switch 110 is depressed, no other functions are currently running (engine stop, cranking, etc.) and the conditions are such that no other function will run.

Referring particularly to FIG. 11, execution of the program for a vehicle not having an emergency pump motor begins with determination at step 200 of the position of the ignition switch. If the ignition switch is not in the OFF position the Key_State is true and execution continues to step 202. If NO the variables Engine_Stop_Relay_Cmd and Engine_Crank_Cmd are reset at step 222 and processing stops. At step 202 ESC 24 determines if remote switch 110 is depressed. If no, the Engine_Crank_Cmd variable is reset at step 224 and processing stops. If a yes resulted at step 202, execution continues to step 204 where the value of the variable "Tem_Rem_Start_Stop_Plunger" is checked.

If the value is "NEW", i.e. the remote switch is newly depressed a value of 1 is stored on a stack in memory, otherwise a value of 0 is entered. A logical AND operation is then implemented on the stack. Next, at step 206 it is determined in the remote stop start PTO interlock is set. If the PTO interlock is set, step 208 is executed to determine if the PTO engagement switch is on and a logical AND operation is performed with 1 and the stack. Otherwise the stack is "ANDed" with 0. At step 210, following step 208 or along the NO branch from step 206, it is determined if the Parking brake is engaged. If yes the stack is ANDed with 1, otherwise with zero. Next, at step 212, if the ignition signal (Ign) to engine controller is on an "AND" operation is performed on the stack with 1 it the Engine_State has a good status. Otherwise the AND operation on the stack uses a 0. Next, at step 214 the stack is interrogated to see if it has the value 1. If NO the conditions for remote start or stop have not been met and processing is exited. If YES, the conditions for a remote stop or start have been met and step 216 is executed to determine if the engine is running. If YES, the Engine_Stop_Relay_Cmd is set and transistor RD15 134 is energized. If NO, the engine stop relay command is reset and engine crank command is issued on output 136.

The required logic is more complex if an emergency pump motor is provided. Referring to FIG. 12 a flow chart for a vehicle equipped with an emergency pump motor is illustrated. Again processing begins with a determination of the key state at step 230 (i.e. the key is not in the OFF position). If the key is in the OFF position (the NO branch), step 268 is executed to reset each of four variables: (1) Engine_Crank_Cmd; (2) Engine_Stop_Relay_Cmd; (3) EmergencyPump_inhibit_Relay; and (4) Start_Stop_Timer and the process is terminated. Otherwise processing continues to step 232 which tests to see if one of three conditions is met (1) if the Accessory_Signal is on or new (in this version the invention also works for ACC being on in the ignition switch 102); (2) the Engine state is on or new; or (3) the remote switch is newly open. If yes, step 234 is executed to set the emergency pump motor relay and to stop the remote switch closed timer. Following the NO branch from step 232 or after step 234 it is determined if the remote switch is dosed. If NO, the routine is exited via step 270 with reset of the engine crank command and the remote switch closure timer. Otherwise step 238 is executed to determine if the remote switch timer has expired. If yes, the process is exited via step 272 with a reset of the emergency pump motor inhibit relay and turning off the timer. Otherwise, along the NO branch from step 238, step 240 is executed to put a 1 on the stack if the remote switch is newly closed. Next, at step 242, if the parameter remote stop/start PTO interlock is set, an AND operation is performed between the stack and 1, but only if the PTO engagement switch is on and has a good status. Otherwise an AND operation is performed between the stack and 0. Next, at step 244, an AND operation between the stack and 1 is done if the parking brake is set, but otherwise with 0.

Next, at step 246 it is determined if the signal Ign is high (as reported by the Engine Controller). If YES, step 248 is executed to determine if the engine status is bad and the remote switch is newly depressed. If YES, step 250 provides that a remote shut down flag be set and remote switch depression timer be started along with a stop timer. Following either the NO branch from step 248 or after step 250, if engine status is bad an AND operation between the stack and 0 is done, but otherwise the AND operation is done against 1. Next, along the NO branch from step 246 or after step 252, the value of stack is compared to 1. If it is not 1, processing ceases. Otherwise, along the YES branch it is determined if the engine state is true. If YES, the engine stop relay command and remote shut down flags are set The remote switch closure timer is started and the engine stop timer is started and processing stops. Following the NO branch from step 256, the remote switch timer is stopped and the engine stop relay command is reset. Next, at step 262 it is determined it the remote shut down flag is set. If YES, the engine crank command is reset and the remote shut down flag is reset. If NO, the remote shut down flag is set, the remote switch timer is started and the remote switch time. Processing then discontinues.

The present invention provides a simple, multifunction remote start/stop control system for a utility vehicle that exhibits robustness. A single control may be used to invoke not only starting and stopping, but also to actuate an electric motor-driven pump in case of engine failure.

While the invention is shown in only one of its forms, it is not thus limited but is susceptible to various changes and modifications without departing from the spirit and scope of the invention.

What is claimed is:

1. A vehicle engine ignition control system, comprising:

a starter solenoid and motor;

engine control electronics;

an engine coupled to the motor for starting and to the engine control electronics for control of its operation;

a multiple position ignition switch having first and second outputs which assume energized states in response to positioning of a key switch, the second output being energized in response to positioning of the key switch in an ignition position and in a start position;

a remote switch providing a connection to ground when closed;

a controller communicating with the engine control electronics and coupled to the remote switch to be responsive to closure of the remote switch and indication that the engine is not currently operating for providing a remote start energization signal;

a remote start relay coupled to respond to the remote start energization signal occurring concurrently with closure of the remote start switch for providing an activation signal on an output; and a starter relay coupled to respond to energization of the first output of the multiple position ignition switch or to the activation signal from the remote start relay for providing activation energization to the starter solenoid and motor.

2. A vehicle engine ignition control system as set forth in claim 1, further comprising:

a vehicle electrical power source;

a chassis ignition relay for coupling power from the vehicle electrical power source to the engine control electronics for maintaining operation of the engine;

a remote switch state detection relay coupled to the remote switch and to the second output of the multiposition ignition switch and responsive to the concurrent occurrence of an energization signal on the second output of the multposition ignition switch and closure of the remote switch to generate a remote stop energization signal;

the controller being further responsive to closure of the remote switch and indication that the engine is operating for providing a ground connection through an input; and a remote stop relay for coupling energization from the multiple position ignition switch to the chassis ignition relay connected to the remote switch state detection relay to receive the remote stop energization signal and further connected to the input of the controller, the remote stop relay being responsive to the remote stop energization signal and grounding through the controller input for interrupting energization of the chassis ignition relay and thereby operation of the engine.

3. A vehicle engine ignition control system as set forth in claim 2, further comprising:

a diode coupled to conduct the activation signal from the output of remote start relay back to a sense input of the remote start relay in backup to possible loss of the energization signal from the controller.

4. A vehicle engine ignition control system as set forth in claim 3, further comprising:

a safety switch connected between the remote start relay and a sense input of the starter relay.

5. A vehicle engine ignition control system as set forth in claim 3, further comprising:

a backup drive motor and solenoid connected to the vehicle electrical power source;

a backup drive motor operation inhibit relay;

a backup drive motor relay coupled to receive energization from a second output of the remote start relay and coupled to the remote switch to be responsive to concurrent closure of the remote switch and application of the energization signal from the remote start relay for coupling energization signal from the remote start relay to the backup drive motor operation inhibit relay as an input; and the controller further providing a connection to ground on an inhibit input in response to the key switch being in the ignition position and engine cranking having been attempted and failed.

6. A vehicle engine ignition control system as claimed in claim 5, further comprising:

the controller being programmed to provide a delay in connecting the inhibit input to ground following stop in engine operation.

7. A utility truck with remote engine shut down and start up, comprising:

an electrical power source;

an engine;

a starter motor mechanically coupled to the engine and starter solenoid for connecting the starter motor to the electrical power source;

a starter relay for supplying electrical power from the electrical power source to the starter solenoid;

a multiple position ignition switch having an output energized by placing a key switch in at least one position other than an off position;

a remote switch having a default open position and a closed position;

an electrical system controller connected to detect the movement of the remote switch to the closed position, the electrical system controller being responsive to detection of movement of the remote switch concurrent with the engine running for supplying a first ground connection on a remote stop relay enable port and for detection of movement of the remote switch concurrent with the engine not running for supplying a remote start relay energization signal on a start signal port; and a remote start relay connected by an input to respond to the remote start relay energization signal on the start signal port of the electrical system controller for connecting the output of the multiple position ignition switch by an output to an input of the starter relay, the starter relay being responsive energization of the output of the multiple position ignition switch for providing an activation signal to the starter solenoid.

8. A utility truck with remote engine shut down and start up as set forth in claim 7, further comprising:

a diode for coupling the energization supplied to the starter relay by the remote start relay back to a sense input of the remote start relay for latching the remote start relay; and the starter relay being connected to the remote switch to remain active after latched for as long as the remote switch is closed.

9. A utility truck with remote engine shut down and start up as set forth in claim 7, further comprising:

an engine controller having an ignition input and responsive to an enable signal on the ignition input for allowing the engine to run;

an ignition relay for supplying an activation signal on the ignition input;

a remote stop relay having an energization input and an enable input for supplying the activation signal to the ignition relay; and the electrical system controller being connected to the enable input of the remote stop relay and further responsive to closure of the remote switch when the engine is running for supplying an enabling signal to the enable input of the remote stop relay.

10. A utility truck with remote engine shut down and start up as set forth in claim 9, further comprising:

a remote switch state detection relay coupled to the remote switch and to the output of the multiposition ignition switch and responsive to the concurrent occurrence of an energization signal on the output of the multiposition ignition switch and closure of the remote switch to generate a remote stop energization signal for application to a energization input of the remote stop relay.

11. A utility truck with remote engine shut down and start up as set forth in claim 10, further comprising:

a backup motor and solenoid for energization from the electrical power source;

the electrical system controller being responsive to conditions indicating a failure of the engine to resume operation after cranking initiated by the remote switch for providing an inhibit disable signal;

a backup motor inhibit relay connected to the electrical system controller to receive the inhibit disable signal;

a backup motor energization relay coupled to the output from multiple position ignition switch and to the remote switch to respond to concurrent closure of the remote switch and an energization signal on the output to apply a backup motor activation signal to the backup motor inhibit relay; and the backup motor inhibit relay being connected between the backup motor energization relay and the backup motor for coupling the backup motor activation signal to the backup motor in response to the inhibit disable signal.

12. A utility truck with remote engine shut down and start up as set forth in claim 11, further comprising:

the inhibit disable signal being the absence of a ground connection through port on the controller.

13. A utility truck with remote engine shut down and start up as set forth in claim 12, further comprising:

a hydraulic pump coupled to be powered by the engine and the back up motor; and a hydraulic lift unit coupled to the hydraulic pump.

14. A utility truck with remote engine shut down and start up as set forth in claim 13, further comprising:

an aerial lift unit including a bucket for an occupant coupled to the hydraulic lift unit to be raised and lowered.

15. A utility truck with remote engine shut down and start up as set forth in claim 14, further comprising:

a pneumatic actuation system accessible from the bucket for the remote switch.

* * * * *